US007216727B2

(12) United States Patent
Wardley

(10) Patent No.: US 7,216,727 B2
(45) Date of Patent: May 15, 2007

(54) DRILLING BIT FOR DRILLING WHILE RUNNING CASING

(75) Inventor: Mike Wardley, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/168,676

(22) PCT Filed: Dec. 21, 2000

(86) PCT No.: PCT/GB00/04936

§ 371 (c)(1),
(2), (4) Date: Jun. 21, 2002

(87) PCT Pub. No.: WO01/46550

PCT Pub. Date: Jun. 28, 2001

(65) Prior Publication Data

US 2002/0189863 A1 Dec. 19, 2002

(30) Foreign Application Priority Data

Dec. 22, 1999 (GB) ..... 9930287.9
Jul. 27, 2000 (GB) ..... 0018309.5

(51) Int. Cl.
*E21B 17/14* (2006.01)

(52) U.S. Cl. ..... 175/402; 175/425; 166/242.8

(58) Field of Classification Search ..... 175/425, 175/402, 412, 327, 171, 307; 166/242.8, 166/376; 76/108.1, 108.2
See application file for complete search history.

(56) References Cited

U.S. PATENT DOCUMENTS

| | | | |
|---|---|---|---|
| 122,514 | A | 1/1872 | Bullock |
| 1,077,772 | A | 11/1913 | Weathersby |
| 1,185,582 | A | 5/1916 | Bignell |
| 1,301,285 | A | 4/1919 | Leonard |
| 1,342,424 | A | 6/1920 | Cotten |
| 1,418,766 | A | 6/1922 | Wilson |
| 1,471,526 | A | 10/1923 | Pickin |
| 1,585,069 | A | 5/1926 | Youle |
| 1,728,136 | A | 9/1929 | Power |
| 1,777,592 | A | 10/1930 | Thomas |

(Continued)

FOREIGN PATENT DOCUMENTS

| | | |
|---|---|---|
| CA | 2 335 192 | 11/2001 |
| DE | 3 213 464 | 10/1983 |
| DE | 3 523 221 | 2/1987 |
| DE | 3 918 132 | 12/1989 |
| DE | 4 133 802 | 10/1992 |

(Continued)

OTHER PUBLICATIONS

PCT International Search Report issued for application serial No. PCT/GB00/04936, on Mar. 15, 2001.
Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.

(Continued)

*Primary Examiner*—Jennifer H. Gay
*Assistant Examiner*—Daniel P Stephenson
(74) *Attorney, Agent, or Firm*—Patterson & Sheridan, L.L.P.

(57) ABSTRACT

A drill bit for drilling casing in a well bore. The drill bit is constructed from a combination of relatively soft and relatively hard materials. The proportions of the materials are selected such that the drill bit provides suitable cutting and boring of the well bore while being able to be drilled through by a subsequent drill bit. Methods of applying hard materials to a soft material body are provided.

38 Claims, 3 Drawing Sheets

U.S. PATENT DOCUMENTS

| | | | | |
|---|---|---|---|---|
| 1,825,026 | A | | 9/1931 | Thomas |
| 1,830,625 | A | | 11/1931 | Schrock |
| 1,842,638 | A | | 1/1932 | Wigle |
| 1,851,289 | A | | 3/1932 | Owen |
| 1,880,218 | A | | 10/1932 | Simmons |
| 1,917,135 | A | | 7/1933 | Littell |
| 1,981,525 | A | | 11/1934 | Price |
| 1,998,833 | A | | 4/1935 | Crowell |
| 2,017,451 | A | | 10/1935 | Wickersham |
| 2,049,450 | A | | 8/1936 | Johnson |
| 2,060,352 | A | | 11/1936 | Stokes |
| 2,102,555 | A | | 12/1937 | Dyer |
| 2,105,885 | A | | 1/1938 | Hinderliter |
| 2,167,338 | A | | 7/1939 | Murcell |
| 2,214,429 | A | | 9/1940 | Miller |
| 2,216,895 | A | | 10/1940 | Stokes |
| 2,228,503 | A | | 1/1941 | Boyd et al. |
| 2,295,803 | A | | 9/1942 | O'Leary |
| 2,305,062 | A | | 12/1942 | Church et al. |
| 2,324,679 | A | | 7/1943 | Cox |
| 2,370,832 | A | | 3/1945 | Baker |
| 2,379,800 | A | | 7/1945 | Hare |
| 2,414,719 | A | | 1/1947 | Cloud |
| 2,499,630 | A | | 3/1950 | Clark |
| 2,522,444 | A | | 9/1950 | Grable |
| 2,536,458 | A | | 1/1951 | Munsinger |
| 2,610,690 | A | | 9/1952 | Beatty |
| 2,621,742 | A | | 12/1952 | Brown |
| 2,627,891 | A | | 2/1953 | Clark |
| 2,641,444 | A | | 6/1953 | Moon |
| 2,650,314 | A | | 8/1953 | Hennigh et al. |
| 2,663,073 | A | | 12/1953 | Bieber et al. |
| 2,668,689 | A | | 2/1954 | Cormany |
| 2,692,059 | A | | 10/1954 | Bolling, Jr. |
| 2,720,267 | A | | 10/1955 | Brown |
| 2,738,011 | A | | 3/1956 | Mabry |
| 2,741,907 | A | | 4/1956 | Genender et al. |
| 2,743,087 | A | | 4/1956 | Layne et al. |
| 2,743,495 | A | | 5/1956 | Eklund ..... 22/202 |
| 2,764,329 | A | | 9/1956 | Hampton |
| 2,765,146 | A | | 10/1956 | Williams |
| 2,805,043 | A | | 9/1957 | Williams |
| 2,953,406 | A | | 9/1960 | Young |
| 2,978,047 | A | | 4/1961 | DeVaan |
| 3,006,415 | A | | 10/1961 | Burns et al. |
| 3,041,901 | A | | 7/1962 | Knights |
| 3,054,100 | A | | 9/1962 | Jones |
| 3,087,546 | A | | 4/1963 | Wooley |
| 3,090,031 | A | | 5/1963 | Lord |
| 3,102,599 | A | | 9/1963 | Hillburn |
| 3,111,179 | A | | 11/1963 | Albers et al. |
| 3,117,636 | A | | 1/1964 | Wilcox et al. |
| 3,122,811 | A | | 3/1964 | Gilreath |
| 3,123,160 | A | | 3/1964 | Kammerer |
| 3,124,023 | A | | 3/1964 | Marquis et al. |
| 3,131,769 | A | | 5/1964 | Rochemont |
| 3,159,219 | A | | 12/1964 | Scott |
| 3,169,592 | A | | 2/1965 | Kammerer |
| 3,191,677 | A | | 6/1965 | Kinley |
| 3,191,680 | A | | 6/1965 | Vincent |
| 3,193,118 | A | | 7/1965 | Kenneday et al. |
| 3,353,599 | A | | 11/1967 | Swift |
| 3,380,528 | A | | 4/1968 | Timmons |
| 3,387,893 | A | | 6/1968 | Hoever |
| 3,392,609 | A | | 7/1968 | Bartos |
| 3,419,079 | A | | 12/1968 | Current |
| 3,477,527 | A | | 11/1969 | Kool |
| 3,489,220 | A | | 1/1970 | Kinley |
| 3,518,903 | A | | 7/1970 | Ham et al. |
| 3,548,936 | A | | 12/1970 | Kilgore et al. |
| 3,550,684 | A | | 12/1970 | Cubberly, Jr. |
| 3,552,507 | A | | 1/1971 | Brown |
| 3,552,508 | A | | 1/1971 | Brown |
| 3,552,509 | A | | 1/1971 | Brown |
| 3,552,510 | A | | 1/1971 | Brown |
| 3,552,848 | A | | 1/1971 | Van Wagner |
| 3,559,739 | A | | 2/1971 | Hutchison |
| 3,566,505 | A | | 3/1971 | Martin |
| 3,570,598 | A | | 3/1971 | Johnson |
| 3,575,245 | A | | 4/1971 | Cordary et al. |
| 3,602,302 | A | | 8/1971 | Kluth |
| 3,603,411 | A | | 9/1971 | Link |
| 3,603,412 | A | | 9/1971 | Kammerer, Jr. et al. |
| 3,603,413 | A | | 9/1971 | Grill et al. |
| 3,606,664 | A | | 9/1971 | Weiner |
| 3,621,910 | A | | 11/1971 | Sanford |
| 3,624,760 | A | | 11/1971 | Bodine |
| 3,635,105 | A | | 1/1972 | Dickmann et al. |
| 3,656,564 | A | | 4/1972 | Brown |
| 3,662,842 | A | | 5/1972 | Bromell |
| 3,669,190 | A | | 6/1972 | Sizer et al. |
| 3,680,412 | A | | 8/1972 | Mayer et al. |
| 3,691,624 | A | | 9/1972 | Kinley |
| 3,691,825 | A | | 9/1972 | Dyer |
| 3,692,126 | A | | 9/1972 | Rushing et al. |
| 3,696,332 | A | | 10/1972 | Dickson, Jr. et al. |
| 3,700,048 | A | | 10/1972 | Desmoulins |
| 3,729,057 | A | | 4/1973 | Werner |
| 3,746,330 | A | | 7/1973 | Taciuk |
| 3,747,675 | A | | 7/1973 | Brown |
| 3,760,894 | A | | 9/1973 | Pitifer |
| 3,776,320 | A | | 12/1973 | Brown |
| 3,776,991 | A | | 12/1973 | Marcus |
| 3,785,193 | A | | 1/1974 | Kinley et al. |
| 3,808,916 | A | | 5/1974 | Porter et al. |
| 3,838,613 | A | | 10/1974 | Wilms |
| 3,840,128 | A | | 10/1974 | Swoboda, Jr. et al. |
| 3,848,684 | A | | 11/1974 | West |
| 3,857,450 | A | | 12/1974 | Guier |
| 3,870,114 | A | | 3/1975 | Pulk et al. |
| 3,881,375 | A | | 5/1975 | Kelly |
| 3,885,679 | A | | 5/1975 | Swoboda, Jr. et al. |
| 3,901,331 | A | | 8/1975 | Djurovic |
| 3,913,687 | A | | 10/1975 | Gyongyosi et al. |
| 3,915,244 | A | | 10/1975 | Brown |
| 3,934,660 | A | | 1/1976 | Nelson |
| 3,945,444 | A | | 3/1976 | Knudson |
| 3,947,009 | A | | 3/1976 | Nelmark |
| 3,964,556 | A | | 6/1976 | Gearhart et al. |
| 3,980,143 | A | | 9/1976 | Swartz et al. |
| 4,049,066 | A | | 9/1977 | Richey |
| 4,054,332 | A | | 10/1977 | Bryan, Jr. |
| 4,054,426 | A | * | 10/1977 | White ..... 51/309 |
| 4,064,939 | A | | 12/1977 | Marquis |
| 4,077,525 | A | | 3/1978 | Callegari et al. |
| 4,082,144 | A | | 4/1978 | Marquis |
| 4,083,405 | A | | 4/1978 | Shirley |
| 4,085,808 | A | | 4/1978 | Kling |
| 4,095,865 | A | | 6/1978 | Denison et al. |
| 4,100,968 | A | | 7/1978 | Delano |
| 4,100,981 | A | | 7/1978 | Chaffin |
| 4,127,927 | A | | 12/1978 | Hauk et al. |
| 4,133,396 | A | | 1/1979 | Tschirky |
| 4,142,739 | A | | 3/1979 | Billingsley |
| 4,173,457 | A | * | 11/1979 | Smith ..... 51/309 |
| 4,175,619 | A | | 11/1979 | Davis |
| 4,186,628 | A | * | 2/1980 | Bonnice ..... 76/108.2 |
| 4,189,185 | A | | 2/1980 | Kammerer, Jr. et al. |
| 4,194,383 | A | | 3/1980 | Huzyak |
| 4,221,269 | A | | 9/1980 | Hudson |
| 4,227,197 | A | | 10/1980 | Nimmo et al. |
| 4,241,878 | A | | 12/1980 | Underwood |
| 4,257,442 | A | | 3/1981 | Claycomb |
| 4,262,693 | A | | 4/1981 | Giebeler |

4,274,777 A 6/1981 Scaggs
4,274,778 A 6/1981 Putnam et al.
4,277,197 A 7/1981 Bingham
4,280,380 A 7/1981 Eshghy
4,281,722 A 8/1981 Tucker et al.
4,287,949 A 9/1981 Lindsey, Jr.
4,311,195 A 1/1982 Mullins, II
4,315,553 A 2/1982 Stallings
4,320,915 A 3/1982 Abbott et al.
4,336,415 A 6/1982 Walling
4,384,627 A 5/1983 Ramirez-Jauregui
4,392,534 A 7/1983 Miida
4,396,076 A 8/1983 Inoue
4,396,077 A * 8/1983 Radtke ..... 175/428
4,407,378 A 10/1983 Thomas
4,408,669 A 10/1983 Wiredal
4,413,682 A 11/1983 Callihan et al.
4,427,063 A 1/1984 Skinner
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al. ..... 175/329
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,610,320 A * 9/1986 Beakley ..... 175/425
4,613,161 A 9/1986 Brisco
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,883,125 A 11/1989 Wilson et al.
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al.
5,009,265 A 4/1991 Bailey et al.
5,022,472 A 6/1991 Bailey et al.
5,027,914 A * 7/1991 Wilson ..... 175/406
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,085,273 A 2/1992 Coone
5,096,465 A 3/1992 Chen et al. ..... 51/295
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley 5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,433,279 A 7/1995 Tassari et al.
5,435,400 A 7/1995 Smith
5,452,923 A 9/1995 Smith
5,456,317 A 10/1995 Hood, III et al.
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al. ..... 175/374
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,611,397 A 3/1997 Wood
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,755,299 A * 5/1998 Langford et al. ..... 175/375
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,794,703 A 8/1998 Newman et al.
5,803,191 A 9/1998 Mackintosh
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A * 9/1999 Caraway ..... 175/57
5,954,131 A 9/1999 Sallwasser
5,957,225 A 9/1999 Sinor ..... 175/57
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.

6,024,169 A 2/2000 Haugen
6,026,911 A 2/2000 Angle et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 * 4/2001 Butcher ..... 76/108.2
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,273,189 B1 8/2001 Gissler et al.
6,275,938 B1 8/2001 Bond et al.
6,290,432 B1 9/2001 Exley et al.
6,296,066 B1 10/2001 Terry et al.
6,305,469 B1 10/2001 Coenen et al.
6,311,792 B1 11/2001 Scott et al.
6,315,051 B1 11/2001 Ayling
6,325,148 B1 12/2001 Trahan et al.
6,343,649 B1 2/2002 Beck et al.
6,347,674 B1 2/2002 Bloom et al.
6,349,764 B1 2/2002 Adams et al.
6,357,485 B2 3/2002 Quigley et al.
6,359,569 B2 3/2002 Beck et al.
6,360,633 B2 3/2002 Pietras
6,367,552 B1 4/2002 Scott et al.
6,367,566 B1 4/2002 Hill
6,371,203 B2 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B2 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny
6,443,241 B1 9/2002 Juhasz et al.
6,443,247 B1 9/2002 Wardley
6,446,723 B1 9/2002 Ramons et al.
6,457,532 B1 10/2002 Simpson
6,458,471 B2 10/2002 Lovato et al.
6,464,004 B1 10/2002 Crawford et al.
6,464,011 B2 10/2002 Tubel
6,484,818 B2 11/2002 Alft et al.
6,497,280 B2 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B2 3/2003 Birckhead et al.
6,536,993 B2 3/2003 Strong et al.
6,538,576 B1 3/2003 Schultz et al.
6,540,025 B2 4/2003 Scott et al.
6,543,552 B1 4/2003 Melcalfe et al.
6,547,017 B1 4/2003 Vail, III
6,553,825 B1 4/2003 Boyd
6,554,064 B1 4/2003 Restarick et al.
6,585,040 B2 7/2003 Hanton et al.
6,591,471 B1 7/2003 Hollingsworth et al.
6,595,288 B2 7/2003 Mosing et al.
6,619,402 B1 9/2003 Amory et al.
6,622,796 B1 9/2003 Pietras
6,634,430 B2 10/2003 Dawson et al.
6,637,526 B2 10/2003 Juhasz et al.
6,648,075 B2 11/2003 Badrak et al.
6,651,737 B2 11/2003 Bouligny
6,655,460 B2 12/2003 Bailey et al.
6,666,274 B2 12/2003 Hughes
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,698,595 B2 3/2004 Norell et al.
6,702,040 B1 3/2004 Sensenig
6,708,769 B2 3/2004 Haugen et al.
6,715,430 B2 4/2004 Choi et al.
6,719,071 B1 4/2004 Moyes
6,722,559 B1 * 4/2004 Millar et al. ..... 228/256
6,725,924 B2 4/2004 Davidson et al.
6,725,938 B1 4/2004 Pietras
6,732,822 B2 5/2004 Slack et al.
6,742,584 B1 6/2004 Appleton
6,742,596 B2 6/2004 Haugen
6,742,606 B2 6/2004 Melcalfe et al.
6,745,834 B2 6/2004 Davis et al.
6,752,211 B2 6/2004 Dewey et al.
6,776,233 B2 8/2004 Meehan
6,832,656 B2 12/2004 Fournier, Jr. et al.
6,832,658 B2 12/2004 Keast
6,837,313 B2 1/2005 Hosie et al.
6,840,322 B2 1/2005 Haynes et al.
6,845,820 B1 1/2005 Hebert et al.
6,848,517 B2 2/2005 Wardley
6,854,533 B2 2/2005 Galloway
6,857,486 B2 2/2005 Chitwood et al.
6,857,487 B2 2/2005 Galloway et al
6,868,906 B1 3/2005 Vail, III et al.
6,877,553 B2 4/2005 Cameron
6,892,835 B2 5/2005 Shahin et al.
6,896,075 B2 5/2005 Haugen et al.
6,899,188 B2 5/2005 Hughes et al.
6,899,772 B1 5/2005 Buytaert et al.
2001/0000101 A1 * 4/2001 Lovato et al. ..... 175/425
2001/0002626 A1 6/2001 Frank et al.

| | | | |
|---|---|---|---|
| 2001/0013412 | A1 | 8/2001 | Tubel |
| 2001/0040054 | A1 | 11/2001 | Haugen et al. |
| 2001/0042625 | A1 | 11/2001 | Appleton |
| 2001/0047883 | A1 | 12/2001 | Hanton et al. |
| 2002/0040787 | A1 | 4/2002 | Cook et al. |
| 2002/0066556 | A1 | 6/2002 | Goode et al. |
| 2002/0074127 | A1 | 6/2002 | Birckhead et al. |
| 2002/0074132 | A1 | 6/2002 | Juhasz et al. |
| 2002/0079102 | A1 | 6/2002 | Dewey et al. |
| 2002/0108748 | A1 | 8/2002 | Keyes |
| 2002/0134555 | A1 | 9/2002 | Allen et al. |
| 2002/0157829 | A1 | 10/2002 | Davis et al. |
| 2002/0162690 | A1 | 11/2002 | Hanton et al. |
| 2002/0170720 | A1 | 11/2002 | Haugen |
| 2002/0189806 | A1 | 12/2002 | Davidson et al. |
| 2002/0189863 | A1 | 12/2002 | Wardley |
| 2003/0034177 | A1 | 2/2003 | Chitwood et al. |
| 2003/0056947 | A1 | 3/2003 | Cameron |
| 2003/0056991 | A1 | 3/2003 | Hahn et al. |
| 2003/0070841 | A1 | 4/2003 | Merecka et al. |
| 2003/0111267 | A1 | 6/2003 | Pia |
| 2003/0141111 | A1 | 7/2003 | Pia |
| 2003/0146023 | A1 | 8/2003 | Pia |
| 2003/0164250 | A1 | 9/2003 | Wardley |
| 2003/0164251 | A1 | 9/2003 | Tulloch |
| 2003/0164276 | A1 | 9/2003 | Snider et al. |
| 2003/0173073 | A1 | 9/2003 | Snider et al. |
| 2003/0173090 | A1 | 9/2003 | Cook et al. |
| 2003/0213598 | A1 | 11/2003 | Hughes |
| 2003/0217865 | A1 | 11/2003 | Simpson et al. |
| 2003/0221519 | A1 | 12/2003 | Haugen et al. |
| 2004/0003490 | A1 | 1/2004 | Shahin et al. |
| 2004/0003944 | A1 | 1/2004 | Vincent et al. |
| 2004/0011534 | A1 | 1/2004 | Simonds et al. |
| 2004/0016575 | A1 | 1/2004 | Shahin et al. |
| 2004/0060697 | A1 | 4/2004 | Tilton |
| 2004/0069500 | A1 | 4/2004 | Haugen |
| 2004/0069501 | A1 | 4/2004 | Haugen et al. |
| 2004/0108142 | A1 | 6/2004 | Vail |
| 2004/0112603 | A1 | 6/2004 | Galloway et al. |
| 2004/0112646 | A1 | 6/2004 | Vail |
| 2004/0118613 | A1 | 6/2004 | Vail |
| 2004/0118614 | A1 | 6/2004 | Galloway et al. |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Vail |
| 2004/0129456 | A1 | 7/2004 | Vail |
| 2004/0140128 | A1 | 7/2004 | Vail |
| 2004/0144547 | A1 | 7/2004 | Koithan et al. |
| 2004/0173358 | A1 | 9/2004 | Haugen |
| 2004/0216892 | A1 | 11/2004 | Giroux et al. |
| 2004/0216924 | A1 | 11/2004 | Pietras et al. |
| 2004/0216925 | A1 | 11/2004 | Metcalfe |
| 2004/0221997 | A1 | 11/2004 | Giroux et al. |
| 2004/0226751 | A1 | 11/2004 | McKay et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |
| 2005/0096846 | A1 | 5/2005 | Koithan et al. |
| 2005/0152749 | A1 | 7/2005 | Anres et al. |

FOREIGN PATENT DOCUMENTS

| | | |
|---|---|---|
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 426 123 | 5/1991 |
| EP | 0 462 618 | 12/1991 |
| EP | 0 474 481 | 3/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2 741 907 | 6/1997 |
| GB | 540 027 | 10/1941 |
| GB | 709 365 | 5/1954 |
| GB | 716 761 | 10/1954 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2115940 | 9/1983 |
| GB | 2 170 528 | 8/1986 |
| GB | 2 201 912 | 9/1988 |
| GB | 2 216 926 | 10/1989 |
| GB | 2 223 253 | 4/1990 |
| GB | 2 221 482 | 7/1990 |
| GB | 2 224 481 | 9/1990 |
| GB | 2 240 799 | 8/1991 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 324 108 | 10/1998 |
| GB | 2 333 542 | 7/1999 |
| GB | 2 335 217 | 9/1999 |
| GB | 2 345 074 | 6/2000 |
| GB | 2 348 223 | 9/2000 |
| GB | 2347445 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 382 361 | 5/2003 |
| GB | 2381809 | 5/2003 |
| GB | 2 386 626 | 9/2003 |
| GB | 2 389 130 | 12/2003 |
| RU | 1808972 | 4/1993 |
| RU | 955765 | 1/1995 |
| RU | 1304470 | 1/1995 |
| RU | 2 079 633 | 5/1997 |
| SU | 112631 | 1/1956 |
| SU | 247162 | 5/1967 |
| SU | 395557 | 8/1973 |
| SU | 415346 | 2/1974 |
| SU | 461218 | 2/1975 |
| SU | 481689 | 8/1975 |
| SU | 501139 | 1/1976 |

| | | |
|---|---|---|
| SU | 581238 | 11/1977 |
| SU | 583278 | 12/1977 |
| SU | 585266 | 12/1977 |
| SU | 601390 | 4/1978 |
| SU | 655843 | 4/1979 |
| SU | 781312 | 11/1980 |
| SU | 899820 | 1/1982 |
| SU | 1 618 870 | 1/1991 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93-07358 | 4/1993 |
| WO | WO 93/24728 | 12/1993 |
| WO | WO 95/10686 | 4/1995 |
| WO | WO 96-18799 | 6/1996 |
| WO | WO 96/28635 | 9/1996 |
| WO | WO 97/05360 | 2/1997 |
| WO | WO 97/08418 | 3/1997 |
| WO | WO 98/01651 | 1/1998 |
| WO | WO 98/09053 | 3/1998 |
| WO | WO 98-11322 | 3/1998 |
| WO | WO 98/32948 | 7/1998 |
| WO | WO 98/55730 | 12/1998 |
| WO | WO 99/04135 | 1/1999 |
| WO | WO 99/11902 | 3/1999 |
| WO | WO 99/23354 | 5/1999 |
| WO | WO 99/24689 | 5/1999 |
| WO | WO 99/35368 | 7/1999 |
| WO | WO 9937881 A2 * | 7/1999 |
| WO | WO 99-41485 | 8/1999 |
| WO | WO 99/50528 | 10/1999 |
| WO | WO 99-58810 | 11/1999 |
| WO | WO 9964713 A1 * | 12/1999 |
| WO | WO 00/04269 | 1/2000 |
| WO | WO 00/05483 | 2/2000 |
| WO | WO 00/08293 | 2/2000 |
| WO | WO 00/09853 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00-39429 | 7/2000 |
| WO | WO 00-39430 | 7/2000 |
| WO | WO 00/41487 | 7/2000 |
| WO | WO 00/46484 | 8/2000 |
| WO | WO 00/50730 | 8/2000 |
| WO | WO 00/50732 | 8/2000 |
| WO | WO 00/66879 | 11/2000 |
| WO | WO 01/12946 | 2/2001 |
| WO | WO 01/46550 | 6/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/14649 | 2/2002 |
| WO | WO 02/44601 | 6/2002 |
| WO | WO 02/81863 | 10/2002 |
| WO | WO 02/086287 | 10/2002 |
| WO | WO 03/006790 | 1/2003 |
| WO | WO 03/074836 | 9/2003 |
| WO | WO 03-087525 | 10/2003 |
| WO | WO 2004/022903 | 3/2004 |

OTHER PUBLICATIONS

M.B. Stone and J. Smith, "Expandable Tubulars and Casing Driling are Options" Drilling Contractor, Jan./Feb. 2002, pp. 52.

M. Gelfgat, "Retractable Bits Development and Application" Transactions of the ASME, vol. 120, Jun. 1998, pp. 124-130.

"First Success with Casing-Drilling" World Oil, Feb. 1999, pp. 25.

Dean E. Gaddy, Editor, "Russia Shares Technical Know-How with U.S." Oil & Gas Journal, Mar. 1999, pp. 51-52 and 54-56.

U.S. Appl. No. 10/794,800, filed Mar. 5, 2004.

U.S. Appl. No. 10/832,804, filed Apr. 27, 2004.

U.S. Appl. No. 10/795,214, filed Mar. 5, 2004.

U.S. Appl. No. 10/794,795, filed Mar. 5, 2004.

U.S. Appl. No. 10/775,048, filed Feb. 9, 2004.

U.S. Appl. No. 10/772,217, filed Feb. 2, 2004.

U.S. Appl. No. 10/788,976, filed Feb. 27, 2004.

U.S. Appl. No. 10/794,797, filed Mar. 5, 2004.

U.S. Appl. No. 10/767,322, filed Jan. 29, 2004.

U.S. Appl. No. 10/795,129, filed Mar. 5, 2004.

U.S. Appl. No. 10/794,790, filed Mar. 5, 2004.

U.S. Appl. No. 10/162,302, filed Jun. 4, 2004.

Rotary Steerable Technology—Technology Gains Momentum, Oil & Gas Journal, Dec. 28, 1998.

Directional Drilling, M. Mims, World Oil, May 1999, pp. 40-43.

Multilateral Classification System w/Example Applications, Alan MacKenzie & Cliff Hogg, World Oil, Jan. 1999, pp. 55-61.

U.S. Appl. No. 10/618,093.

U.S. Appl. No. 10/189,570.

Tarr, et al., "Casing-while-Drilling: The Next Step Change In Well Construction," World Oil, Oct. 1999, pp. 34-40.

De Leon Mojarro, "Breaking A Paradigm: Drilling With Tubing Gas Wells," SPE Paper 40051, SPE Annual Technical Conference And Exhibition, Mar. 3-5, 1998, pp. 465-472.

De Leon Mojarro, "Drilling/Completing With Tubing Cuts Well Costs By 30%," World Oil, Jul. 1998, pp. 145-150.

Littleton, "Refined Slimhole Drilling Technology Renews Operator Interest," Petroleum Engineer International, Jun. 1992, pp. 19-26.

Anon, "Slim Holes Fat Savings," Journal of Petroleum Technology, Sep. 1992, pp. 816-819.

Anon, "Slim Holes, Slimmer Prospect," Journal of Petroleum Technology, Nov. 1995, pp. 949-952.

Vogt, et al., "Drilling Liner Technology For Depleted Reservoir," SPE Paper 36827, SPE Annual Technical Conference And Exhibition, Oct. 22-24, pp. 127-132.

Mojarro, et al., "Drilling/Completing With Tubing Cuts Well Costs by 30%," World Oil, Jul. 1998, pp. 145-150.

Sinor, et al., Rotary Liner Drilling For Depleted Reservoirs, IADC/SPE Paper 39399, IADC/SPE Drilling Conference, Mar. 3-6, 1998, pp. 1-13.

Editor, "Innovation Starts At The Top At Tesco," The American Oil & Gas Reporter, Apr. 1998, p. 65.

Tessari, et al., "Casing Drilling—A Revolutionary Approach To Reducing Well Costs," SPE/IADC Paper 52789, SPE/IADC Drilling Conference, Mar. 9-11, 1999, pp. 221-229.

Silverman, "Novel Drilling Method—Casing Drilling Process Eliminates Tripping String," Petroleum Engineer International, Mar. 1999, p. 15.

Silverman, "Drilling Technology—Retractable Bit Eliminates Drill String Trips," Petroleum Engineer International, Apr. 1999, p. 15.

Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.

Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.

Tessari, et al., "Focus: Drilling With Casing Promises Major Benefits," Oil & Gas Journal, May 17, 1999, pp. 58-62.

Laurent, et al., "Hydraulic Rig Supports Casing Drilling," World Oil, Sep. 1999, pp. 61-68.

Perdue, et al., "Casing Technology Improves," Hart's E & P, Nov. 1999, pp. 135-136.

Warren, et al., "Casing Drilling Application Design Considerations," IADC/SPE Paper 59179, IADC/SPE Drilling Conference, Feb. 23-25, 2000 pp. 1-11.

Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono-Santos, et al., "Drilling With Casing Advances To Floating Drilling Unit With Surface BOP Employed," Paper WOCD-0307-01, World Oil Casing Drilling Technical Conferece, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Alexander Sas-Jaworsky and J. G. Williams, Development of Composite Coiled Tubing For Oilfield Services, SPE 26536, Society of Petroleum Engineers, Inc., 1993.
A. S. Jafar, H.H. Al-Attar, and I. S. El-Ageli, Discussion and Comparison of Performance of Horizontal Wells in Bouri Field, SPE 26927, Society of Petroleum Engineers, Inc. 1996.
G. F. Boykin, The Role of A Worldwide Drilling Organization and the Road to the Future, SPE/IADC 37630, 1997.
M. S. Fuller, M. Littler, and I. Pollock, Innovative Way To Cement a Liner Utitizing a New Inner String Liner Cementing Process, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges In Deep Waters And Maturing Properities, IBP 27500, Brazilian Petroleum Institute—IBP, 2000.
Coiled Tubing Handbook, World Oil, Gulf Publishing Company, 1993.
U.S. Appl. No. 10/189,570, filed Jun. 6, 2002.
U.S. Appl. No. 10/618,093, filed Jul. 11, 2003.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LeFleur Petroleum Services, Inc., "Autoseal Circulating Head," Engineering Manufacturing, 1992, 11 Pages.
Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.

* cited by examiner

DRILLING BIT FOR DRILLING WHILE RUNNING CASING

This application is a National Stage of International Application No. PCT/GB00/04936, filed Dec. 21, 2000, which claims priority to Great Britain patent application no. 9930287.9, filed Dec. 22, 1999, and Great Britain patent application no. 0018309.5, filed Jul. 27, 2000.

The present invention relates to drilling tools as are typically used for drilling well bores.

Conventionally, when drilling a well bore of the type used in oil or gas production, a string of drill pipe having a drill bit on the lower end thereof is advanced into the ground. As the drill is advanced into the ground it encounters different rock formations, some of which may be unstable. To minimise problems which may be incurred by running the drill bit from one formation to another, it is common practice to run the drill bit to a predetermined depth, and then remove or "trip" the drill string from the bore. Structural casing, typically made of heavy steel piping, is then lowered into the bore and cemented in place when set. The casing acts as a lining within the bore, and prevents collapse of the newly drilled bore or contamination of the oil or gas reservoir.

As a consequences of having to carry out the above procedure, the cost and time taken to drill a bore is increased as it is necessary to perform a number of trips down the well. It will be appreciated that at the considerable depths reached during oil and gas production the time taken to implement complex retrieval procedures to recover the drill string can be very long, and accordingly the beginning of profitable production can be greatly delayed.

An attempt has been made to mitigate this problem with the introduction of a procedure known as "drilling with casing". This procedure relies on the attachment of a drill bit to the actual casing string, so that the drill bit functions not only to drill the earth formation, but also to guide the casing into the well bore. This is advantageous as the casing is pulled into the bore by the drill bit, and therefore negates the requirement of having to retrieve the drill string and drill bit after reaching a target depth to allow cementing.

While this procedure greatly increases the efficiency of the drilling procedure, a further problem is encountered when the casing is cemented upon reaching the desired depth. The advantage of drilling with casing is that the drill bit does not have to be retrieved from the well bore. However as a result, should drilling to a greater depth be required after cementing the casing, the subsequent drill bit has to pass through the previous bit in order to advance. This is extremely difficult as drill bits are required to remove hard rock material and are accordingly very resistant and robust structures typically manufactured from materials such as Tungsten Carbide or steel. Attempting to drill through an old drill bit may result in damaging the new drill bit, adversely affecting the efficiency of any further drilling. Consequently, the damaged drill bit would have to be retrieved from the bore and replaced, and the time and cost advantage gained by using the drilling with casing procedure would be lost.

It would therefore be a distinct advantage to provide a drill bit for use during drilling with casing which can drill rock and earth formations but which can also be drilled through by another drill bit. The provision of a drill bit which allows the passage of a subsequent drill bit through it, would reduce the number of trips into a well bore required during a normal drilling procedure and minimise the risk of damaging any further drill bits introduced into the bore.

In our prior Patent Application PCT/GB99/01816 we have suggested that the drill bit has hard drilling material that may be moved away from the remaining body of the drill shoe prior to subsequent drilling through of the drill bit. We have also proposed EP0815342, a drill bit or shoe having hard drilling material placed only on the drill shoe or bit at the peripheral circumference thereof, and specifically only at the sides of the drill bit or shoe where the diameter is greater than the internal diameter of the casing. The present invention is distinguished from both of these teachings in that it provides for a drill shoe or bit that has hard material within the area below the internal boundaries of the casing, and does not require moving parts to be displaced before subsequent drilling through can be commenced.

It is an object of the present invention to provide a drill bit for use in a well bore which can drill earth and rock formations and guide a casing string into a well bore simultaneously.

It is a further object of the present invention to provide a drill bit for use in a well bore which is constructed from a material which allows a second drill bit to drill through it.

It is a yet further object of the present invention to provide a drill bit for use in a well bore which allows a second drill bit to drill through it, such that the second drill bit is not damaged and can progress beyond the point reached by the original drill bit within the well bore.

According to a first aspect of the present invention there is provided a drill bit for drilling with casing in a well bore, said drill bit being constructed from a combination of a relatively soft material and a relatively hard material, wherein the hard material is suitable for cutting earth or rock, and wherein the combination of materials is in such proportion and in such arrangement to allow a subsequent further drill bit to drill through it.

Preferably the drill bit is substantially constructed from the relatively soft material, wherein the relatively soft material is adapted to be drilled through with a standard earth drill bit.

Preferably the drill bit is formed with a body having or being associated with a nose portion upon which are cutting members, wherein the body is made substantially from the relatively soft material and at least the leading edge or cutting surface of each cutting member is made from the hard material.

Preferably the hard wearing material is a hard material such as tungsten carbide or a superhard material such as diamond composite or cubic boron nitride although any other suitable material may be used.

Preferably the soft, drillable material is aluminium. Alternatively the soft drillable material is copper or brass alloy, although any other suitable material could be used.

There may be a plurality of soft materials and there may be a plurality of hard materials.

In one possible embodiment the nose is directly coated with the hard wearing material.

Optionally the coating is a continuous layer or film that covers the surface of the nose.

Alternatively the coating is non-continuous, such that the nose is afforded areas which are not coated by the hard wearing material, wherein upon rotation of the drill bit the cumulative effect of the coated areas gives complete circumferential coverage of the dimensions of the drilled hole.

Alternatively the coating may be applied to an intermediate which is amenable to the nose of the drill bit.

Preferably the intermediate is nickel.

The intermediate may be attached to the nose prior to coating with the hard wearing material. Optionally the intermediate may be coated with the hard wearing material prior to attachment to the nose.

In a second embodiment the hard wearing material is applied to the nose in the form of preformed elements wherein the cumulative effect of said preformed elements is to cover the surface of the nose and so act as a coating thereof.

The preformed elements may be chips or fragments of the hard material.

The preformed elements of the hard material may be directly applied to the nose.

Alternatively the preformed elements of hard material are applied to the nose following the application of an amenable intermediate material to the nose or the preformed elements.

Preferably the amenable intermediate material is nickel substrate.

The preformed elements may be attached to the nose by standard techniques such as brazing, welding or shrink fitting.

Optionally the preformed elements have a re-enforced structure to aid drilling of hard formations. Where the preformed elements have a re-enforced structure, preferably the preformed elements are pre-weakened prior to attachment to the nose in order to allow fracture of the preformed elements upon drilling.

Preferably the drill bit may also comprise a plurality of flow ports to allow fluid bypass and lubrication of the bit.

Preferably the drill bit also comprises a stabiliser or centraliser.

Preferably the drill bit also comprises reaming members.

According to a third aspect of the present invention there is provided a method of fixing a hard or super hard wearing material to a drill bit nose made of a soft drillable material, wherein a jet is used to blow gases at very high speeds towards a cast of the nose and particles of the hard or superhard wearing material are introduced into the gas stream, wherein the kinetic energy of the procedure is converted to thermal energy which welds the particles to the nose.

According to a fourth aspect of the present invention there is provided a method for fixing a hard or superhard wearing material to a drill bit nose made of a soft drillable material, wherein particles of the hard or superhard wearing material are placed within a mould and thereafter the soft drillable material is poured in molten form into the mould, such that on cooling said hard or superhard wearing particles are set in situ.

Alternatively the hard wearing material can be fixed to the nose by a standard technique such as brazing, welding and electroplating.

In order to provide a better understanding of the invention, example embodiments of the invention will now be illustrated with reference to the following Figures in which.

Figure 1:
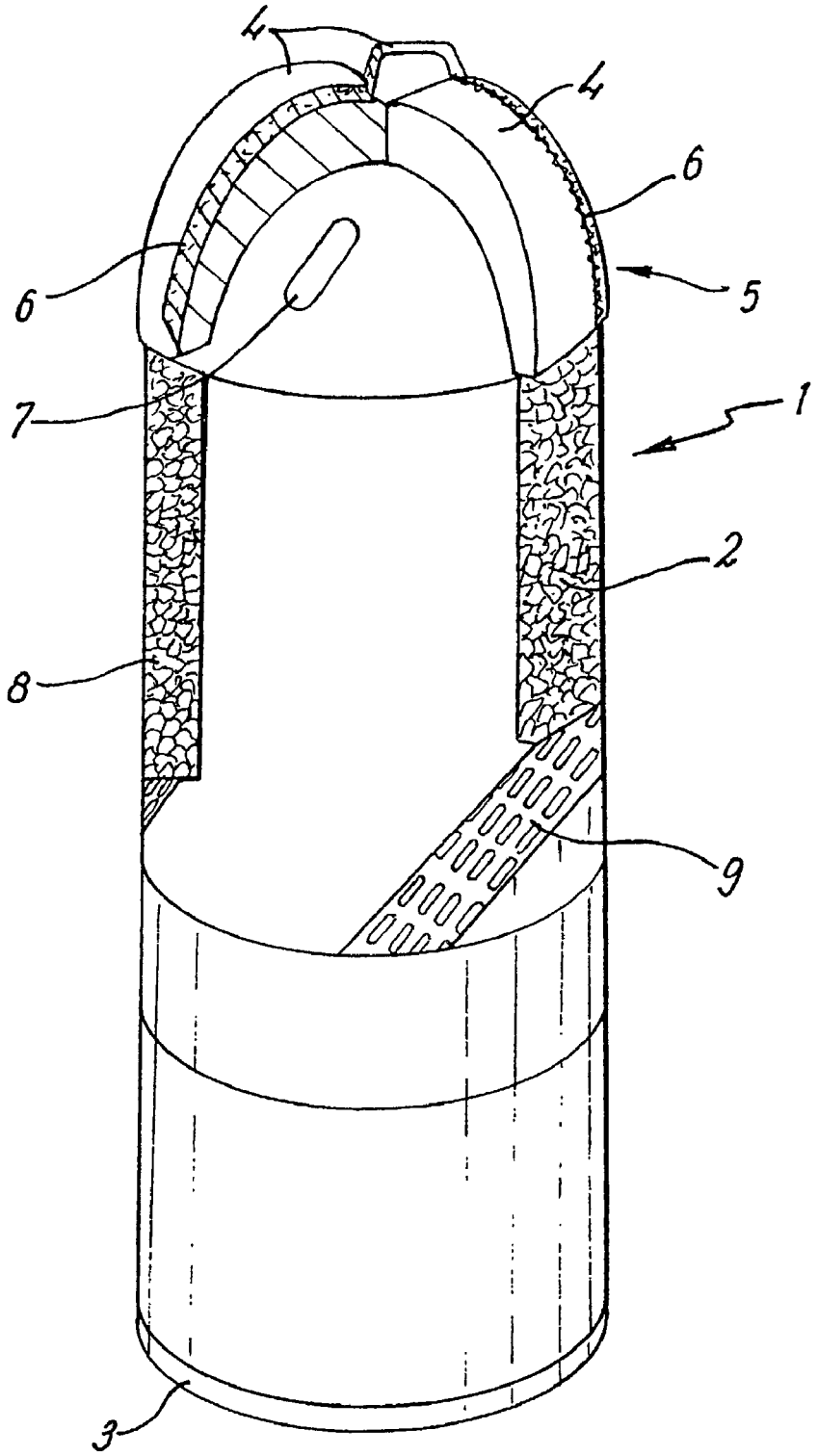
FIG. 1 illustrates a drill bit in accordance with the present invention.

Referring firstly to FIG. 1, a drill bit generally depicted at 1, is comprised of a cylindrical body 2, that can be mounted on the lower end of a casing string (not shown) via a thread end connection 3 that can mate with the casing. The drill bit 1 is further comprised of a plurality of cutting members 4 which are fixed to the opposite end of the body 2 to the thread end connection 3, namely the nose end 5. The cutting members 4 extend out from the nose end 5.

The nose 5 and cutting members 4 are constructed from a material such as aluminium, copper or brass alloy which is soft enough to allow the aforementioned nose 5 and members 4 to be drilled through by a second and subsequent drill bit (not shown). The cutting members 4 are substantially covered by a relatively hard material 6 typically being a hard material such as tungsten carbide or a superhard material such as diamond composite or cubic boron nitride. In the depicted embodiment the relatively hard material 6 is located at the "leading edge" of the cutting member 4. In this respect the "leading edge" refers to the side of the cutting member 4 which directly contacts the ground or rock upon rotation of the drill bit 1. It is recognised that whilst in the depicted embodiments the hard wearing material is afforded to the leading edge of one or more cutting members 4 on the drill bit 1, the invention is not limited to this configuration. For example the hard wearing material may be applied to the nose 5 in an embodiment having no cutting members 4 or may be applied to the whole surface of the cutting members 4.

The relatively hard material 6 may be applied to the cutting members 4 or nose 5 as a coating, that is as a layer or film. In one embodiment a continuous layer of the material 6 may cover the entire surface of the nose 5, or the cutting members 4. Alternatively a non-continuous layer of the material may coat the nose 5 or cutting members 4. In this instance, the surface of the nose 5 or cutting members 4 will comprise areas that are not coated. However, upon rotation of the drill bit 1, the cumulative effect of the coated areas will be complete circumferential coverage of the inside diameter of the casing in which the drill bit is located.

It is recognised in the present invention that direct application of some coatings to the nose material may not be practical. For example, extremely hard tungsten carbide particles cannot be applied to the preferred nose materials (e.g. aluminium or copper) by lasercarb welding. This material can be applied to soft nickel, however machining said drill bit 1 entirely from nickel would be unduly expensive. Therefore in an alternative embodiment, a coating of the hard material 6 is applied to an intermediate, typically being nickel substrate, which is then attached to the nose 5 of the drill bit 1. Alternatively the nickel substrate can be attached to the nose 5 prior to coating.

In a further embodiment preformed elements of the hard or superhard material 6 are applied to the nose 5 or cutting members 4 of the drill bit 1 in place of a coating of film. Said preformed elements may be chips, or fragments of the hard material 6. Typically the culmative effect of the preformed elements is to cover the surface of the nose 5 or the cutting members 4 and so act as a coating thereof. The preformed elements may be directly applied to the nose 5 or cutting members 4 or may be applied after applying an amenable material either to the nose 5 or cutting members 4 or the preformed element itself. The amenable material is typically nickel substrate.

Figure 2:
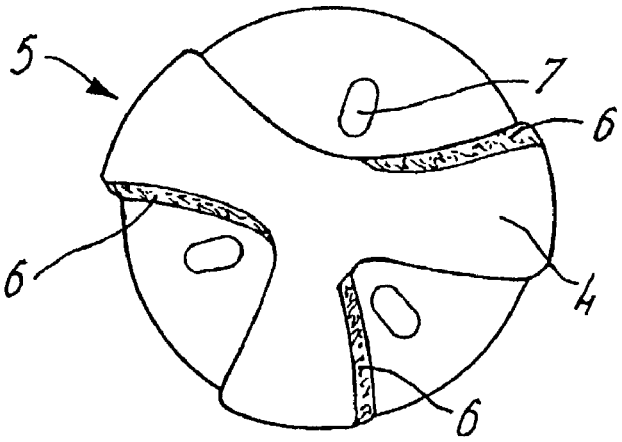
FIG. 2 is an elevated view of the top of the drill bit.
Figure 3:
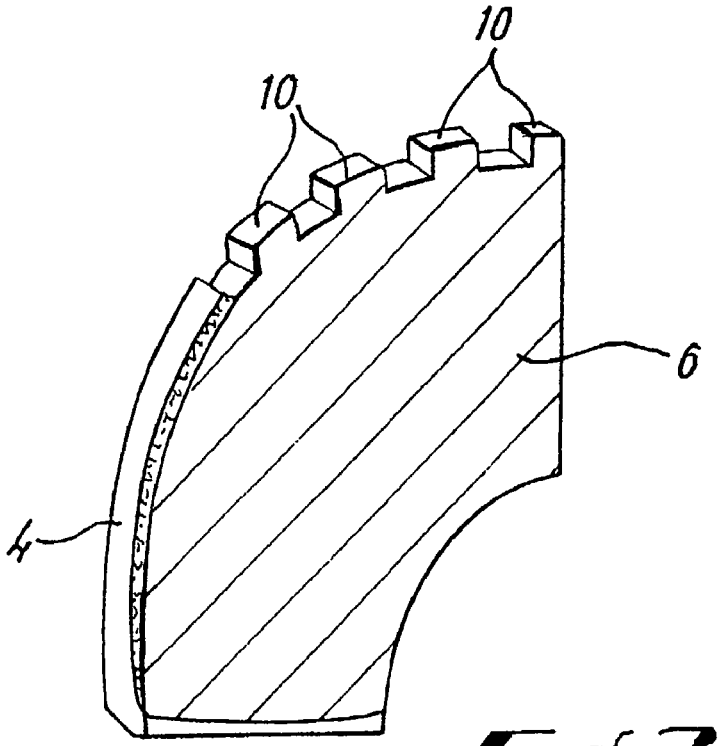
FIG. 3 illustrates an individual cutting member isolated from the drill bit.
Figure 4:
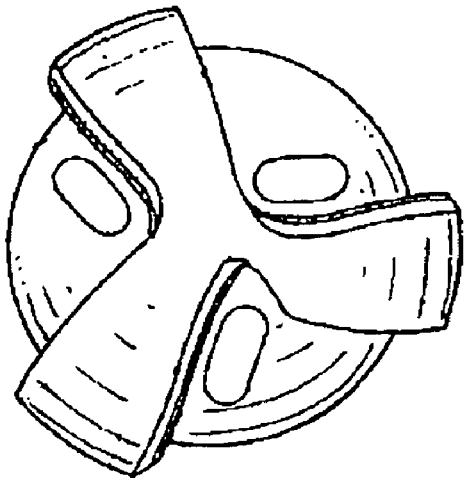
FIG. 4 illustrates an elevated view of the top of an alternative embodiment of a drill bit in accordance with the present invention.
Figure 5:
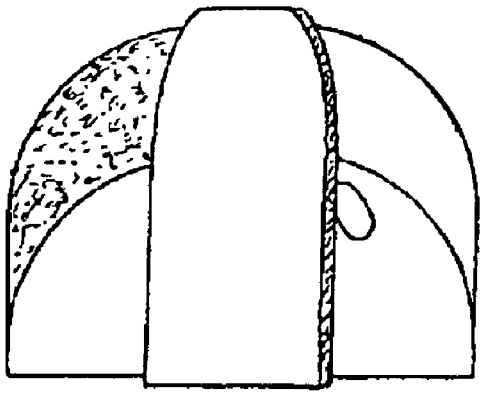
FIG. 5 illustrates a pre-formed element for attaching to the nose portion of a drill bit.

The layout of cutting members 4 can be seen more clearly in FIG. 2 which shows the nose end 5, viewed from above, and in FIG. 3 which shows an individual cutting member 4. It can be seen in FIG. 3 that the cutting means 6 has teeth formations 10 which allow any "chips" of material remaining in the well bore to pass through the blade structure.

The nose 5 further comprises flow by areas 7 that allow fluid circulated within the well bore to lubricate the surfaces of the bit 1. The body 2 also comprises a stabiliser or centraliser 9 which maintains the drill bit in the centre of the well bore, and reaming members 8, which function to remove any irregularities or obstructions from the wall of the bore.

In use, the drill bit 1, is run into a well bore (not shown) from the surface, typically whilst being rotated. The drill bit 1 pulls a casing string (not shown) as it is advanced into the newly formed well bore to a predetermined depth. Upon reaching this depth, the casing is cemented to strengthen the lining of the bore. If drilling beyond this first assembly is required, a second drill bit of a smaller diameter to the first is run into the well inside the casing string from the surface.

Upon reaching the first assembly, the new drill bit can drill through the soft drillable material of the original drill bit 1 and cutting members 4, and therefore can proceed to a point beyond the depth reached by the original drill bit 1 within the well bore. The hard or super hard material 6 fixed to the cutting members 4 of the original drill bit 1 disintegrate into shavings when drilled. The shavings released into the well bore when the original bit 1 is drilled through do not obstruct the bore and are therefore not detrimental to the subsequent drilling process. In this manner a further section of the bore can be drilled beyond the previously attained depth without damage to the new drill bit and without needing to retrieve the first assembly from the bore.

When used for drilling through harder formations a thicker section of the preformed element will be required. However it will be appreciated that in such an instance, said preformed elements would not be drillable. Thereby in the event that a thicker element is required, said element is typically pre-weakened prior to attachment to the nose 5 or cutting members 4. In this manner, the elements will have the attributes of high stiffness whilst drilling but low resistance to fracture whilst being drilled. The preformed elements can then be applied directly to the nose 5 or cutting members 4 by brazing or shrink-fitting or could be attached to an amenable material, typically nickel substrate.

A first method for fixing the hard or superhard material 6 is now outlined. A jet is used to blow gases at very high speeds towards a cast or block of the cutting member 4 or nose 5, and which is made from the soft, drillable material. Typically a speed in the region of Mach 2 is used. Very fine particles of the hard or superhard wearing material are introduced into the gas stream. The resulting kinetic energy is converted to thermal energy in the particles, and accordingly the heated particles "weld" to the leading edge of the cast or block therefore forming a thin layer or film.

It will be appreciated that the abovedescribed method could be used with particles of the hard or superhard material, or with intermediates coated by the hard or super hard material or with preformed elements as described above.

An alternative method for fixing preformed hard or superhard particles to the cutting members 4 is to place them within a drill mould. Molten drillable soft material that will eventually become the nose 5 of the drill bit 1 is then poured into the mould. On cooling the metal provides a drill bit 1 that has the hard or superhard particles set in situ.

The present invention is inherent with significant advantages in that the time taken for the drilling operation can be greatly reduced as there is no need to implement complex and timely retrieval operations to recover apparatus from the bore. As a result the profitable stage of production can be begin much sooner.

A further advantage, is that unlike the drill bits known to the art, the drill bit of the present invention is drillable by another drill bit and the risk of damage to the second drill bit is therefore reduced. Furthermore as the cutting means of the cutting members consist of fine layers or cutting elements formed from hard material, they disintegrate into shavings upon drilling and therefore do not act as an obstruction to any subsequent apparatus that is advanced into the well.

Further modifications and improvements may be incorporated without departing from the scope of the invention herein intended.

The invention claimed is:

1. A drill bit for drilling with casing in a wellbore, comprising:

a nose; and cutting members disposed on the nose and made from a combination of a relatively soft base material, a relatively soft intermediate material, and a relatively hard material, wherein:

the hard material is suitable for cutting earth or rock, the combination of materials is in such proportion and in such arrangement to allow a standard earth drill bit to drill through said drill bit without substantially damaging said standard earth bit, the cutting members are substantially made from the base material, the intermediate material is amenable to the base material and disposed between the hard material and the base material;

the hard material is applied to the cutting members as preformed elements, the cumulative effect of said preformed elements is to cover the surface of the cutting members, thereby acting as a coating thereof, and the performed elements are chips or fragments of the hard material.

2. The drill bit of claim 1, wherein the cutting members are disposed proximate to a center of the nose.

3. The drill bit of claim 1, wherein the nose comprises a flow port.

4. A drill bit as claimed in claim 1, wherein the nose is a one piece nose.

5. A drill bit as claimed in claim 1, further comprising a body, wherein the nose is disposed on the body and the body is made substantially form the relatively soft material.

6. A drill bit as claimed in claim 1, wherein the hard material is tungsten carbide.

7. A drill bit as claimed in claim 1, wherein the hard material is diamond composite.

8. A drill bit as claimed in claim 1, wherein the hard material is cubic boron nitride.

9. A drill bit as claimed in claim 1, wherein the base material is aluminum.

10. A drill bit as claimed in claim 1, wherein the base material is copper or brass alloy.

11. A drill bit as claimed in claim 1, having a plurality of base materials.

12. A drill bit as claimed in claim 1, having a plurality of hard materials. of the coated areas gives complete circumferential coverage of the dimensions of the drilled well bore.

13. A drill bit as claimed in claim 1, wherein the intermediate material is nickel.

14. A drill bit as claimed in claim 1 wherein the intermediate material is brass.

15. A drill bit as claimed in claim 1, also comprising a plurality of flow ports to allow fluid bypass and lubrication of the bit.

16. A drill bit as claimed in claim 1, also comprising a stabilizer or centralizer.

17. A drill bit as claimed in claim 1, also comprising reaming members.

18. A drill bit as claimed in claim 1, wherein the intermediate material and the hard material are disposed on at least a leading edge or cutting surface of each cutting member.

19. A drill bit for drilling with casing in a well bore, comprising:

a nose; and cutting members:

disposed on the nose, having preformed elements made from a relatively hard material, and made from a combination of a relatively soft base material and a relatively soft bonding material, wherein:

the hard material is suitable for cutting earth or rock, the cutting members are made substantially from the base material, and the bonding material is disposed on at least a leading edge or cutting surface of each cutting member between the hard material and the base material so that, when the nose is drilled through by a standard earth bit, the bonding material will not substantially impede separation of the preformed elements, thereby allowing the standard earth bit to drill through the drill bit without substantially damaging the standard earth bit.

20. A drill bit as claimed in claim 19, wherein the bonding material is nickel or brass.

21. The drill bit of claim 19, wherein the cutting members are disposed proximate to a center of the nose.

22. A drill bit as claimed in claim 19, wherein the hard material is tungsten carbide.

23. A drill bit as claimed in claim 19, wherein the hard material is diamond composite or cubic boron nitride.

24. A drill bit as claimed in claim 19, wherein the base material is aluminum.

25. A drill bit as claimed in claim 19, wherein the base material is copper or brass alloy.

26. A drill bit as claimed in claim 19, wherein the preformed elements have a reinforced structure to aid drilling of hard formations.

27. A drill bit as claimed in claim 26, wherein the preformed elements are pre-weakened prior to attachment to the nose in order to allow fracture of the preformed elements upon drill through by the standard earth bit.

28. A drill bit as claimed in claim 19, also comprising a stabilizer or centralizer.

29. A drill bit as claimed in claim 19, also comprising reaming members.

30. The drill bit of claim 19, wherein the nose comprises a flow port.

31. A drill bit as claimed in claim 19, wherein the bonding material is nickel.

32. A drill bit as claimed in claim 19, further comprising a body, wherein the nose is disposed on the body and the body is made substantially from the base material.

33. A drill bit for drilling with casing in a wellbore, comprising:

a nose; and cutting members disposed on the nose and made from a combination of a relatively soft base material, a relatively soft intermediate material, and a relatively hard material, wherein:

the hard material is suitable for cutting earth or rock, the combination of materials is in such proportion and in such arrangement to allow a standard earth drill bit to drill through said drill bit without substantially damaging said standard earth bit, the cutting members are substantially made from the base material, the intermediate material is amenable to the base material and disposed between the hard material and the base material;

the hard material is applied to the cutting members as preformed elements, the cumulative effect of said preformed elements is to cover the surface of the cutting members, thereby acting as a coating thereof, and the preformed elements have a reinforced structure to aid drilling of hard formations.

34. A drill bit as claimed in claim 33, wherein the preformed elements are pre-weakened prior to attachment to the nose in order to allow fracture of the preformed elements upon chill through by the standard earth bit.

35. A drill bit as claimed in claim 33, wherein the cutting members are disposed proximate to a center of the nose.

36. A drill bit as claimed in claim 33 wherein the hard material is tungsten carbide, cubic boron nitride, or diamond composite.

37. A drill bit as claimed in claim 33, wherein base material is aluminum, copper, or brass alloy.

38. A drill bit as claimed in claim 37, wherein the intermediate material is nickel.

* * * * *

UNITED STATES PATENT AND TRADEMARK OFFICE

CERTIFICATE OF CORRECTION

PATENT NO. : 7,216,727 B2
APPLICATION NO. : 10/168676
DATED : May 15, 2007
INVENTOR(S) : Mike Wardley It is certified that error appears in the above-identified patent and that said Letters Patent is hereby corrected as shown below:

Title Page
<u>In Section (56) References Cited:</u>

In the U.S. Patent Documents, on Page 5, please delete "6,899,188 5/2005 Hughes et al." and insert --6,899,186 5/2005 Galloway et al.--.

<u>In the Claims:</u>

In Column 6, Claim 5, Line 41, please delete "form" and insert --from--;

In Column 6, Claim 12, Lines 55-56, please delete "of the coated areas gives complete circumferential coverage of the dimensions of the drilled well bore.";

In Column 8, Claim 34, Line 37, please delete "chill" and insert --drill--.

Signed and Sealed this

Twenty-first Day of August, 2007

JON W. DUDAS
*Director of the United States Patent and Trademark Office*